US007207857B2

(12) United States Patent
Zheng

(10) Patent No.: US 7,207,857 B2
(45) Date of Patent: Apr. 24, 2007

(54) FLOATING ASSEMBLIES

(75) Inventor: Yu Zheng, Walnut, CA (US)

(73) Assignee: Patent Category Corp., Walnut, CA (US)

( * ) Notice: Subject to any disclaimer, the term of this patent is extended or adjusted under 35 U.S.C. 154(b) by 0 days.

(21) Appl. No.: 11/230,415

(22) Filed: Sep. 20, 2005

(65) Prior Publication Data

US 2007/0066162 A1 Mar. 22, 2007

(51) Int. Cl.
*B63C 9/08* (2006.01)

(52) U.S. Cl. ..... 441/130; 441/131

(58) Field of Classification Search ..... 441/35, 441/129, 130, 131

See application file for complete search history.

(56) References Cited

U.S. PATENT DOCUMENTS

| | | | | |
|---|---|---|---|---|
| 143,904 | A | 10/1873 | Hilgenreiner | |
| 220,032 | A | 9/1879 | Mock | |
| 264,814 | A * | 9/1882 | Wood | 441/127 |
| 1,946,998 | A | 2/1934 | Armstrong | |
| 1,960,474 | A | 5/1934 | Browne | |
| 2,959,796 | A | 11/1960 | De Sander et al. | |
| 3,201,126 | A | 8/1965 | Nissen | |
| 3,561,762 | A | 2/1971 | Russell | |
| 3,580,578 | A | 5/1971 | McCarthy | |
| 3,656,749 | A | 4/1972 | Reyes | |
| 3,808,616 | A | 5/1974 | White | |
| 3,895,801 | A | 7/1975 | Baird | |
| 3,960,161 | A | 6/1976 | Norman | |
| 3,960,193 | A | 6/1976 | Davis | |
| 3,990,463 | A | 11/1976 | Norman | |
| 4,022,187 | A | 5/1977 | Roberts | |
| 4,145,786 | A | 3/1979 | Myers | |
| 4,204,357 | A | 5/1980 | Harrington | |
| 4,241,533 | A | 12/1980 | Newsome | |
| 4,576,375 | A | 3/1986 | Roberts | |
| 4,709,928 | A | 12/1987 | Willingham | |
| 4,721,140 | A | 1/1988 | Coker | |
| 4,815,784 | A | 3/1989 | Zheng | |
| 4,825,892 | A | 5/1989 | Norman | |
| 4,832,652 | A | 5/1989 | Matsuyama | |
| 4,858,634 | A | 8/1989 | McLeese | |
| 4,861,300 | A | 8/1989 | Casagrande et al. | |
| 4,910,855 | A | 3/1990 | Balarzs | |

(Continued)

FOREIGN PATENT DOCUMENTS

| | | |
|---|---|---|
| FR | 2635136 | 9/1990 |

OTHER PUBLICATIONS

"Kargo Gear" Brochure, by Kel-Gar, Inc. 1998.

*Primary Examiner*—Stephen Avila
(74) *Attorney, Agent, or Firm*—Raymond Sun

(57) ABSTRACT

A floating assembly for suspending a person on water has a sheet material that defines the periphery for the floating assembly. A plurality of floatation devices are attached to the periphery. The plurality of floatation devices includes a top floatation device that forms a head pillow, a first side floatation device, and a second side floatation device positioned opposite to the first side floatation device. A first arm space is defined between the top floatation device and the first side floatation device, and a second arm space is defined between the top floatation device and the second side floatation device. The periphery can also be defined by a foldable frame member that has a folded and an unfolded orientation.

2 Claims, 8 Drawing Sheets

U.S. PATENT DOCUMENTS

| | | | |
|---|---|---|---|
| 4,951,333 | A | 8/1990 | Kaiser et al. |
| 5,024,262 | A | 6/1991 | Huang |
| 5,038,812 | A | 8/1991 | Norman |
| 5,054,791 | A | 10/1991 | Ball |
| 5,098,108 | A | 3/1992 | McKinney |
| 5,116,273 | A | 5/1992 | Chan |
| 5,163,461 | A | 11/1992 | Ivanovich et al. |
| D331,482 | S | 12/1992 | Mitchell |
| 5,223,135 | A | 6/1993 | MacPhee et al. |
| 5,261,846 | A | 11/1993 | Hanna |
| 5,301,999 | A | 4/1994 | Thompson et al. |
| 5,326,299 | A | 7/1994 | Jasinski |
| 5,358,440 | A | 10/1994 | Zheng |
| 5,370,145 | A | 12/1994 | Wu |
| 5,377,577 | A | 1/1995 | Bounkong et al. |
| 5,385,165 | A | 1/1995 | Hazinski et al. |
| 5,427,381 | A | 6/1995 | Macaluso et al. |
| 5,429,437 | A | 7/1995 | Shaw et al. |
| 5,433,433 | A | 7/1995 | Armell |
| 5,439,017 | A | 8/1995 | Brown |
| 5,439,018 | A | 8/1995 | Tsai |
| 5,467,794 | A | 11/1995 | Zheng |
| 5,524,900 | A | 6/1996 | Allen |
| 5,553,908 | A | 9/1996 | Shink |
| 5,560,385 | A | 10/1996 | Zheng |
| 5,592,961 | A | 1/1997 | Chin |
| 5,601,105 | A | 2/1997 | Blen et al. |
| 5,611,380 | A | 3/1997 | Landy |
| 5,645,096 | A | 7/1997 | Hazinski et al. |
| 5,671,479 | A | 9/1997 | Dedrick |
| 5,676,168 | A | 10/1997 | Price |
| 5,690,133 | A | 11/1997 | Capwell |
| 5,722,446 | A | 3/1998 | Zheng |
| 5,778,915 | A | 7/1998 | Zheng |
| 5,800,067 | A | 9/1998 | Easter |
| 5,816,278 | A | 10/1998 | Kim |
| 5,816,954 | A | 10/1998 | Zheng |
| 5,885,123 | A | 3/1999 | Clifford |
| 5,927,793 | A | 7/1999 | McGrath, Jr. |
| 6,004,219 | A | 12/1999 | Peabody |
| 6,030,300 | A | 2/2000 | Zheng |
| 6,058,521 | A | 5/2000 | O'Brien |
| 6,062,243 | A | 5/2000 | Tuch et al. |
| D426,415 | S | 6/2000 | Le Gette et al. |
| 6,073,283 | A | 6/2000 | Zheng |
| 6,088,953 | A | 7/2000 | Morgan |
| 6,092,544 | A | 7/2000 | Zheng |
| 6,098,349 | A | 8/2000 | Zheng |
| 6,170,100 | B1 | 1/2001 | Le Gette et al. |
| 6,192,635 | B1 | 2/2001 | Zheng |
| 6,264,573 | B1 | 7/2001 | Zheng |
| 6,266,904 | B1 | 7/2001 | Zheng |
| 6,276,979 | B1 | 8/2001 | Saltel et al. |
| D447,661 | S | 9/2001 | Le Gette et al. |
| D449,193 | S | 10/2001 | Le Gette et al. |
| 6,360,761 | B1 | 3/2002 | Zheng |
| 6,478,038 | B1 | 11/2002 | Le Gette et al. |
| 6,485,344 | B2 | 11/2002 | Arias |
| 6,519,793 | B2 | 2/2003 | Le Gette et al. |
| 6,881,114 | B2 | 4/2005 | Zheng |
| 6,908,353 | B2 | 6/2005 | Zheng |
| 2002/0102889 | A1 | 8/2002 | Arias |
| 2003/0143904 | A1 | 7/2003 | Morrow et al. |
| 2003/0220032 | A1 | 11/2003 | Hsu et al. |
| 2003/0232551 | A1* | 12/2003 | Zheng ..... 441/130 |

* cited by examiner

FLOATING ASSEMBLIES

BACKGROUND OF THE INVENTION

1. Field of the Invention

The present invention relates to collapsible structures, and in particular, to collapsible floating assemblies which offer multiple uses, and which may be twisted and folded to reduce the overall size of the assembly to facilitate convenient storage and use.

2. Description of the Prior Art

Collapsible objects have recently become popular with both adults and children. Examples of such collapsible objects are shown and described in U.S. Pat. No. 5,038,812 (Norman), U.S. Pat. No. 5,467,794 (Zheng) and U.S. Pat. No. 5,560,385 (Zheng) in the form of collapsible structures. These structures can be used as play structures, shelters, tents, and storage structures, among other uses. These structures may be twisted and folded to reduce the overall size of the structures to facilitate convenient storage and use. As such, these structures are being enjoyed by many people in many different applications.

Other examples of collapsible objects include blanket, mat and floating assemblies as illustrated in one or more of U.S. Pat. No. 6,073,283 (Zheng), U.S. Pat. No. 6,170,100 (Le Gette et al.), U.S. Pat. No. 6,343,391 (Le Gette et al.) and U.S. Pat. No. 6,908,353 (Zheng). These assemblies can be used as blankets, floor mats, and floating mats. These blankets and mats may be twisted and folded to reduce the overall size of the blanket or mat to facilitate convenient storage and use.

SUMMARY OF THE DISCLOSURE

It is an object of the present invention to provide a floating assembly that offers increased flexibility in use.

In order to accomplish the objects of the present invention, there is provided a floating assembly for suspending a person on water, the floating assembly having a sheet material that defines the periphery for the floating assembly. A plurality of floatation devices are attached to the periphery. The plurality of floatation devices includes a top floatation device that forms a head pillow, a first side floatation device, and a second side floatation device positioned opposite to the first side floatation device. A first arm space is defined between the top floatation device and the first side floatation device, and a second arm space is defined between the top floatation device and the second side floatation device.

In accordance with another embodiment of the present invention, the periphery can be defined by a foldable frame member that has a folded and an unfolded orientation.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

Figure 1:
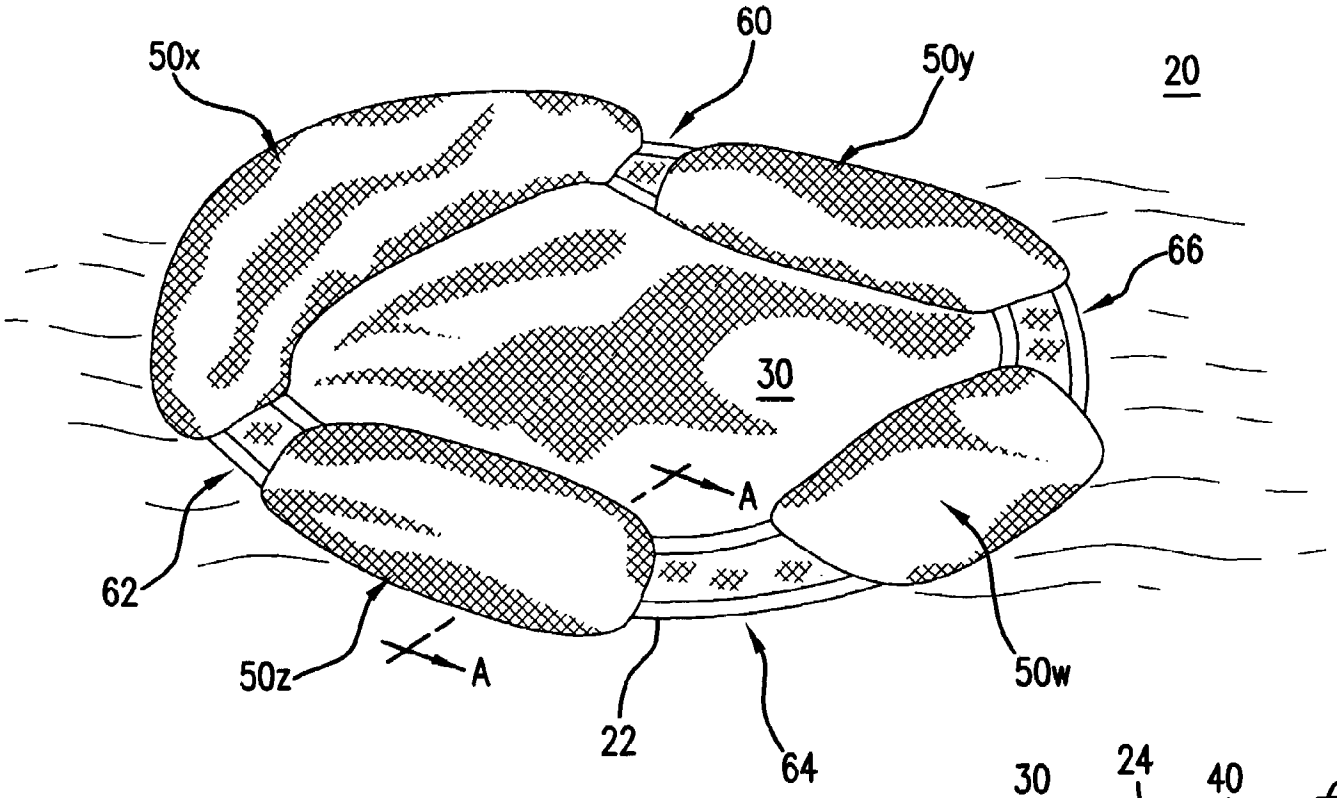
FIG. 1 is a perspective view of a floating assembly according to one embodiment of the present invention shown in use in its expanded configuration.
Figure 2:
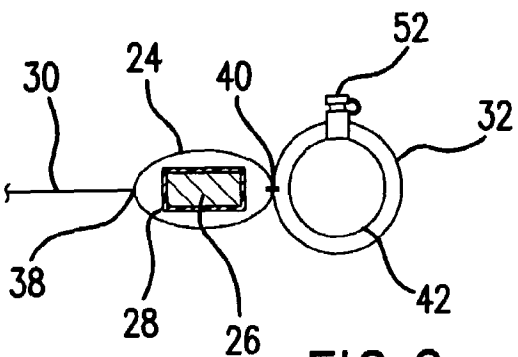
FIG. 2 is a cross-sectional view of the assembly of FIG. 1 taken along line A—A thereof.

Referring to FIGS. 1 and 2, the present invention provides a floating assembly 20 that can assume any configuration, such as circular, oval, or rectangular, square, trapezoidal, or irregular. The assembly 20 has a peripheral edge 22 that extends all the way around the assembly 20. A peripheral frame retaining sleeve 24 is provided along and traverses the peripheral edge 22, and a frame member 26 is retained or held within the frame retaining sleeve 24 such that the frame member 24 extends completely around the peripheral edge 22.

The frame member 26 may be provided as one continuous loop, or may be a strip of material connected at both ends to form a continuous loop, or can be a strip of material having opposite ends that are adjacent to (but not connected to) each other. The frame member 26 is preferably formed of flexible coilable steel, although other materials such as plastics may also be used. The frame member 26 should be made of a material which is relatively strong and yet is flexible to a sufficient degree to allow it to be coiled. Thus, the frame member 26 is capable of assuming two positions, an open or expanded position such as shown in FIG. 1, or a folded position (see FIG. 3D) in which the frame member is collapsed into a size which is much smaller than its open position. The frame member 26 may be merely retained within the frame retaining sleeve 24 without being connected thereto. Alternatively, the frame retaining sleeve 24 may be mechanically fastened, stitched, fused, or glued to the frame member 26 to retain the frame member 26 in position.

In addition, a protective covering 28 can be provided to cover the frame member 26. The protective covering 28 can be the same as that which is described in U.S. Pat. No. 5,845,697 to Zheng, whose entire disclosure is incorporated by this reference as though set forth fully herein. The protective covering 28 can be effective in preventing the metallic frame member 26 from rust and damage due to its anticipated exposure to water.

Sheet material 30 extends across the interior space defined by the sleeve 24, and is held taut by the frame member 26 when the sheet material 30 is in its open position. The term "sheet material" is to be given its broadest meaning and should be made from strong, flexible yet lightweight materials and may include woven fabrics, sheet fabrics, meshed fabrics or even films. The sheet material 30 can be water-resistant and durable to withstand the wear and tear associated with extended use, and rough treatment by adults and children. The sheet material 30 can also allow water to pass therethrough (e.g., such as a meshed material).

As illustrated best in FIG. 2, the sleeve 24 may attached to the sheet material 30 by a stitching 38. The stitching 38 can also operate to enclose the sleeve 22. Alternatively, the sleeve 24 can be a part of or an extension of the sheet material 30, where the outer edge of the sheet material 30 is wrapped around the frame member 26 to enclose the frame member 26, and then a stitching 38 is applied to enclose the sleeve 24.

A plurality of floatation devices 50 are provided in spaced-apart manner about the peripheral edge 22. Each floatation device 50 includes a separate floatation sleeve 32 that can be stitched to the sleeve 24 by a stitching 40. Thus, the floatation devices 50 can be permanently attached (e.g., by stitching 40, welding or fusing), or removably attached (e.g., by hooks, VELCRO™ pads, etc.), to the peripheral edge of the sleeve 24. The floatation device 50 can be embodied in any desirable structure, including but not limited to one or more foam pieces, or one or more inflatable bags 42, housed inside the floatation sleeve 32. FIGS. 1 and 2 illustrate the use of an inflatable bag 42 which has a hollow interior that is adapted to receive an inflation medium (e.g., air or liquid) via a port 52 that extends through the floatation sleeve 32.

As an alternative, the sleeve 32 can be omitted and the inflatable bag 42 can be stitched directly to the sheet material 30 or the sleeve 24.

Figure 5:
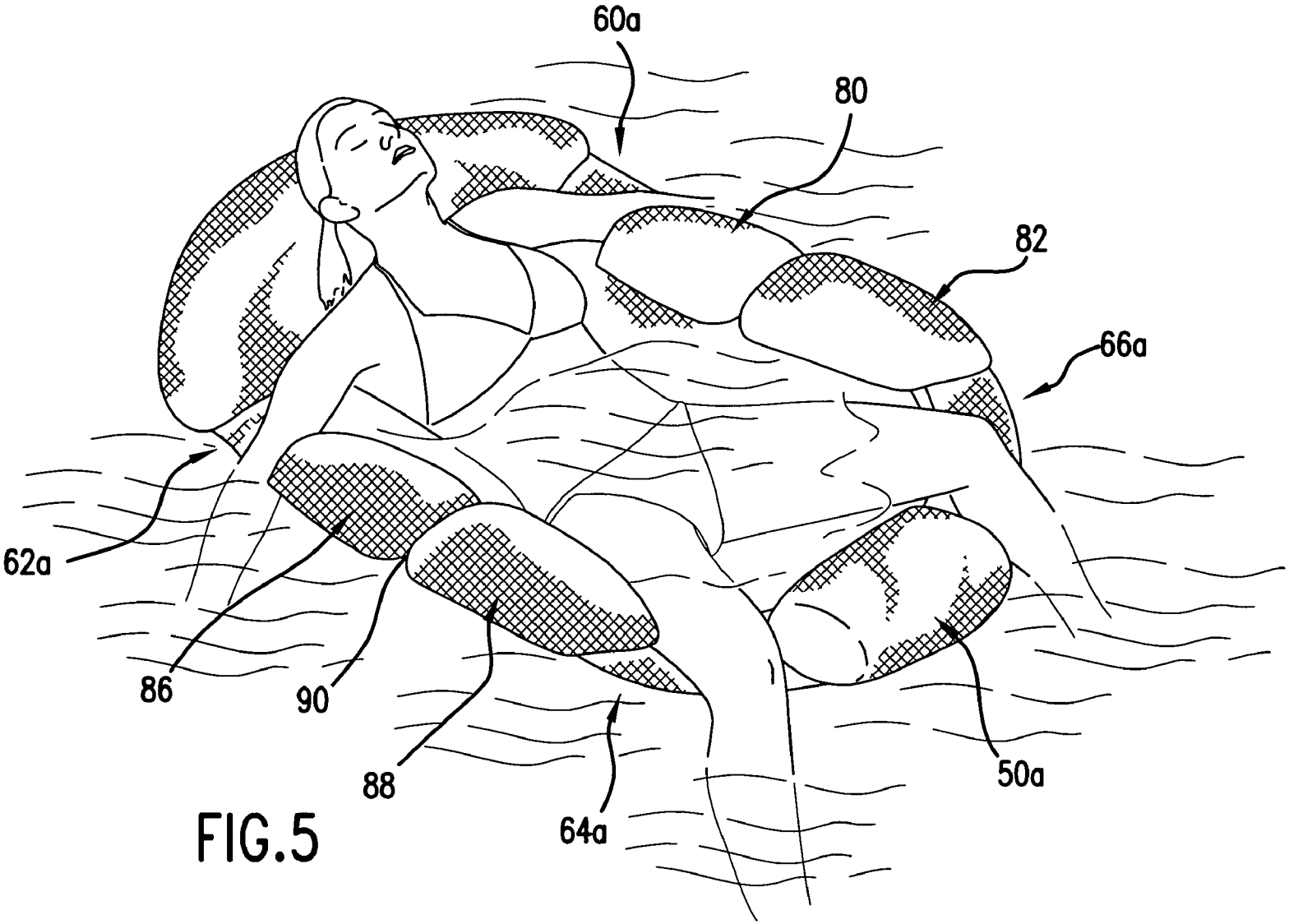
FIG. 5 illustrates the assembly of FIG. 4 in use by a user.

The floatation devices 50 are spaced-apart about the peripheral edge 22 so as to define an open space between each pair of adjacent floatation devices 50. In particular, at least four separate floatation devices 50*w*, 50*x*, 50*y*, 50*z* are provided to define four separate open spaces 60, 62, 64 and 66 between each other. Each of these spaces 60, 62, 64, 66 is provided along the peripheral edge 22, and each is adapted to receive part of a human limb when a user is lying on the sheet material 30. For example, when the user lies on the sheet material 30 with the head resting on the top floatation device 50*x* (which can function as a head pillow), part of each of the user's arms can extend through one of the spaces 60 and 62, and part of each of the user's legs can extend through one the spaces 64 and 66, which are separated by a bottom floatation device 50*w*. FIG. 5 illustrates the positioning of a user's limbs through these spaces 60, 62, 64, 66 in connection with a modification of the embodiment shown in FIGS. 1–3F.

In use, the user can inflate the floatation devices 50 and then place the assembly 20 into a body of water (e.g., swimming pool, beach, lake, etc.). The user can then climb on to the top surface of the assembly 20 and then lie on the assembly 20 as the assembly 20 floats on the water, as shown in FIG. 5. Extending the user's arms and legs through the spaces 60, 62, 64, 66 will enhance the user's comfort because the arms and legs can be maintained relatively flat with respect to the rest of the user's body. Otherwise, the user's arms and legs would have to be supported directly on an inflated floatation device 50, which is less comfortable because the inflated floatation device 50 would cause the arms and legs to be raised.

Figure 3B:
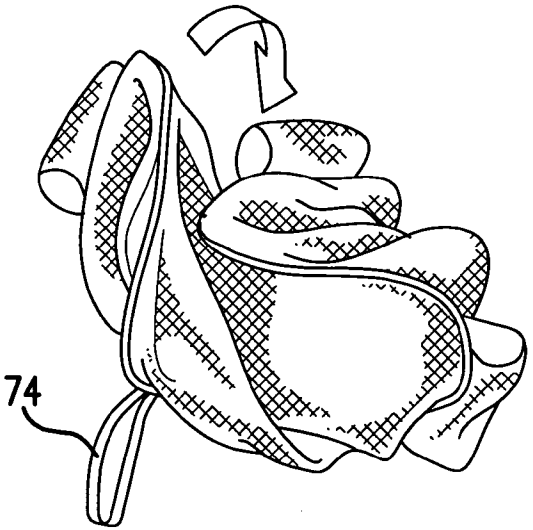
FIGS. 3A–3F illustrate how the assembly of FIG. 1 can be twisted and folded for compact storage.
Figure 3C:
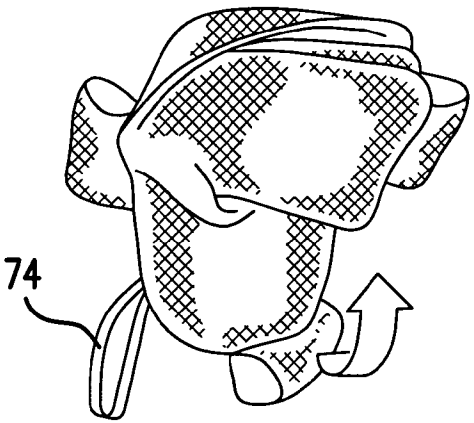
Figure 3A:
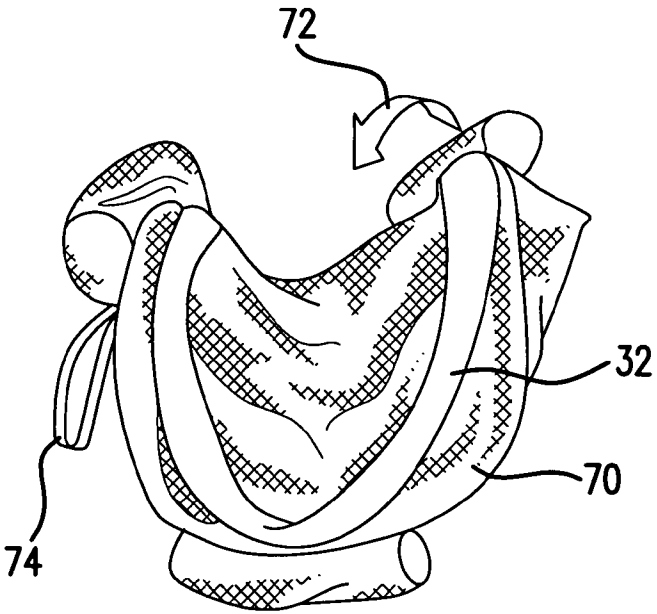
Figure 3E:
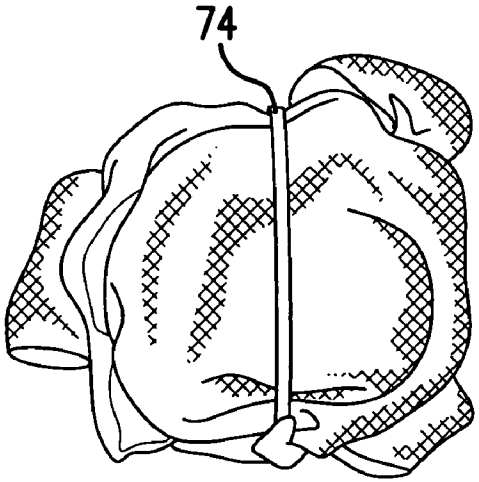

To store the assembly 20, the user first deflates the floatation devices 50 so that the entire assembly 20 can have a generally flat profile. The assembly 20 can then be folded and collapsed into a compact configuration for storage, as illustrated in FIGS. 3A–3F. In the first step illustrated in FIG. 3A, the opposite border 70 of the assembly 20 is folded in (see arrow 72) to collapse the frame member 26 with the sheet material 30. As shown in FIG. 3B, the next step is to continue the collapsing so that the initial size of the assembly 20 is reduced. FIG. 3C shows the next step with the frame member 26 and sheet material 30 collapsed on each other to provide for a small essentially compact configuration having a plurality of concentric frame members 26 and layers of the sheet material 30 so that the collapsed assembly 20 has a size which is a fraction of the size of the initial assembly 20, as shown in FIG. 3D.

In addition, a retaining member or strap 74 (shown in FIGS. 3A–3E only) may be attached to the peripheral edge 22. As shown in FIGS. 3D and 3E, the strap 74 may be used to tie or hold the collapsed assembly 20 in the collapsed position. Alternatively, a bag (not shown) may be used to store the collapsed assembly 20.

Figure 3F:
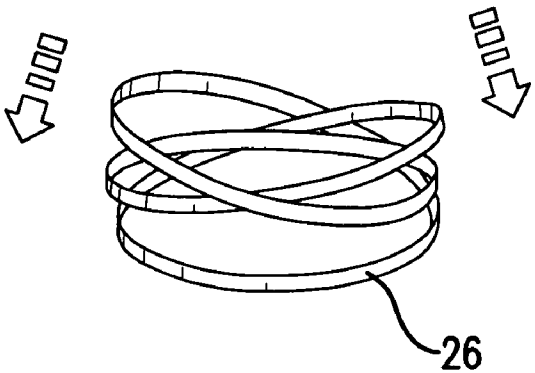
Figure 3D:
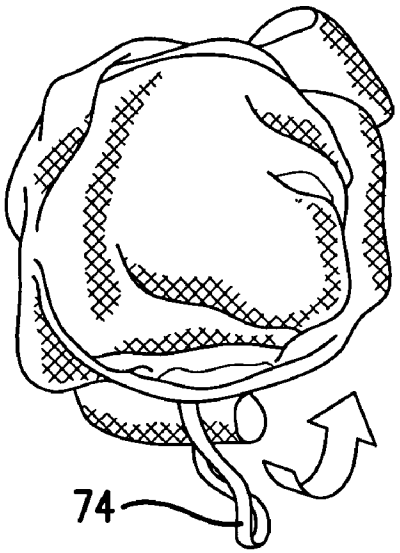

FIG. 3F illustrates the closed loop of the frame member 26 in the collapsed position. The structure of each closed loop essentially consists of two sets of three concentric rings intertwined to lie flat. In the collapsed position, the structure will have a significantly reduced diameter which makes it easy to store the collapsed assembly 20. This reduced size is especially convenient when the assembly 20 is to be used away from the home, such as during travel or at the beach where the assembly 20 can be easily and conveniently packed, stored and transported.

The assembly 20 can be expanded again by opening the coiled frame member 26. The bias and resiliency of the frame member 26 will cause the frame member 26 (and the attached sheet material 30) to automatically open out to the expanded position shown in FIG. 1.

Figure 4:
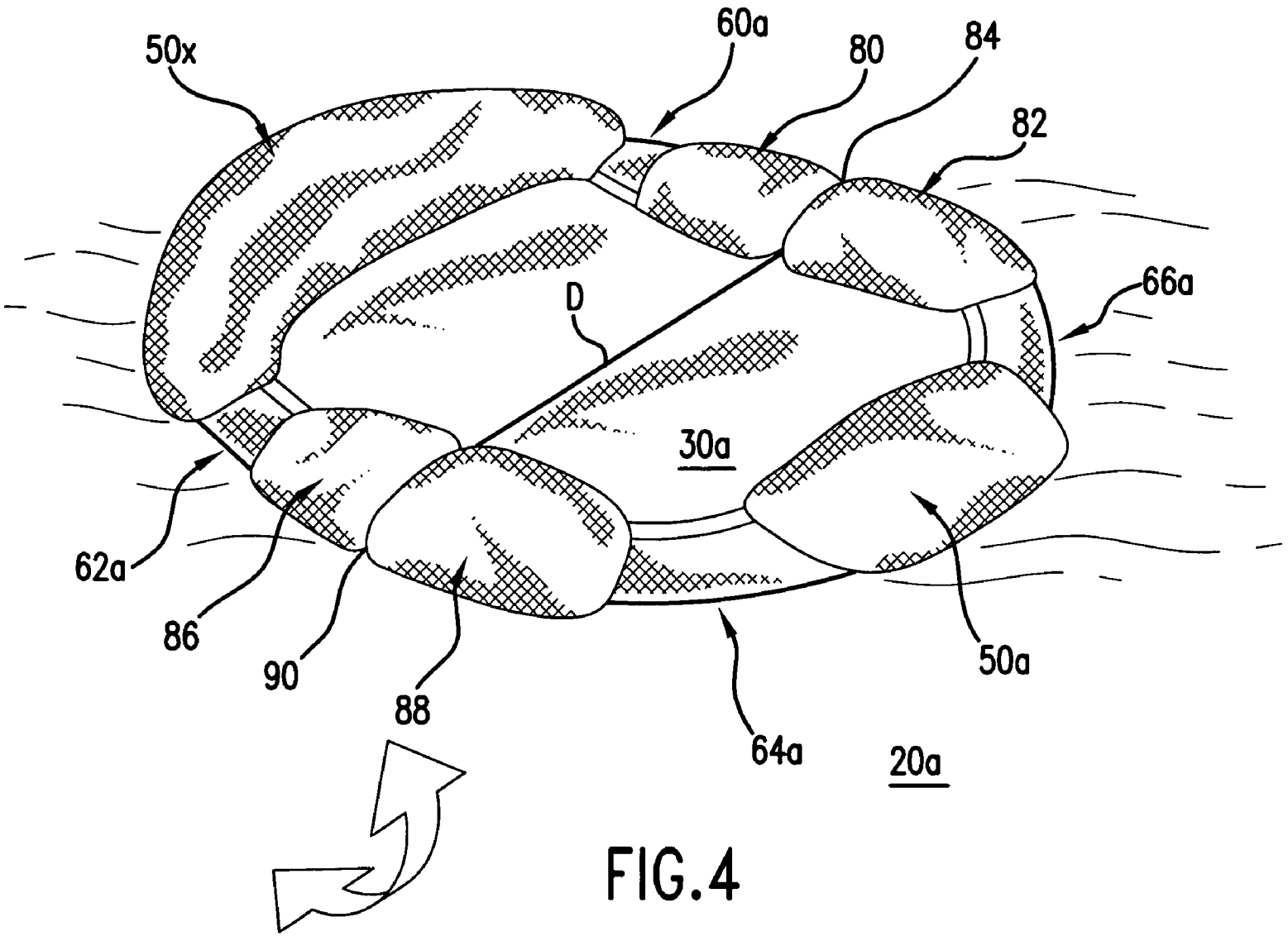
FIG. 4 is a perspective of a floating assembly according to another embodiment of the present invention.

FIG. 4 illustrates another floating assembly 20*a* according to the present invention. The assembly 20*a* is essentially the same as the assembly 20 of FIG. 1, so the same numeral designations will be used for both the assemblies 20 and 20*a*, except that an "a" is added to the designations in FIG. 4. The assembly 20*a* is essentially the same as the assembly 20 of FIG. 1, except that (i) the assembly 20*a* does not have a peripheral frame member 26, and (ii) each of the two side floatation devices 50*y* and 50*z* are now divided into two separate floatation devices. Thus, the floatation device 50*y* in FIG. 1 is now divided into two separate floatation devices 80 and 82 that are separated by a small gap 84 therebetween, and the floatation device 50*z* in FIG. 1 is now divided into two separate floatation devices 86 and 88 that are separated by a small gap 90 therebetween. The gaps 84 and 90 are aligned by a dividing line D that extends from one gap 84 to the other gap 90. In addition, since the frame member 26 and its sleeve 24 are now omitted, the periphery of the sheet material 30*a* can be hemmed to prevent it from splaying.

Figure 6:
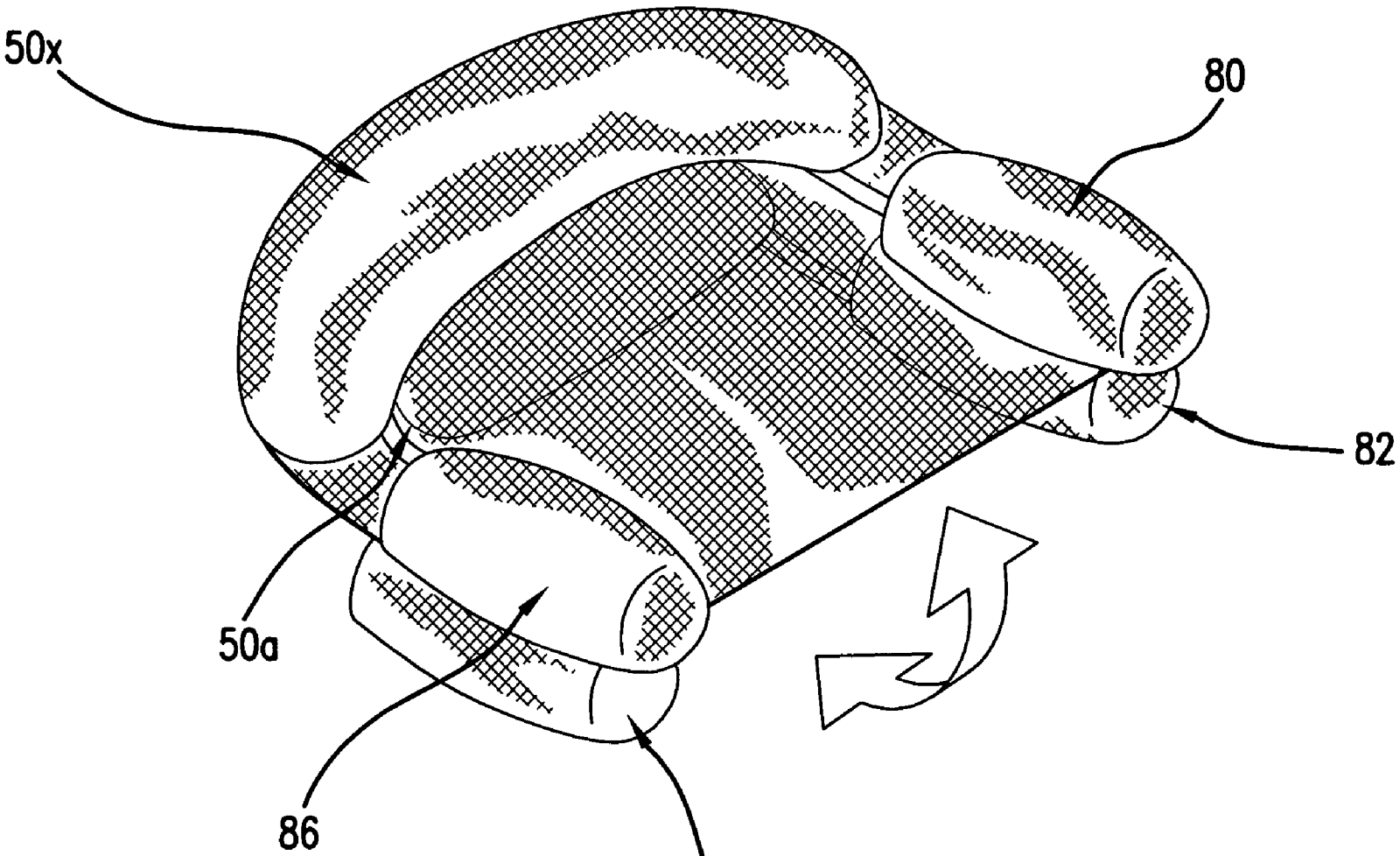
FIG. 6 illustrates the assembly of FIG. 4 after it has been folded in half.
Figure 7:
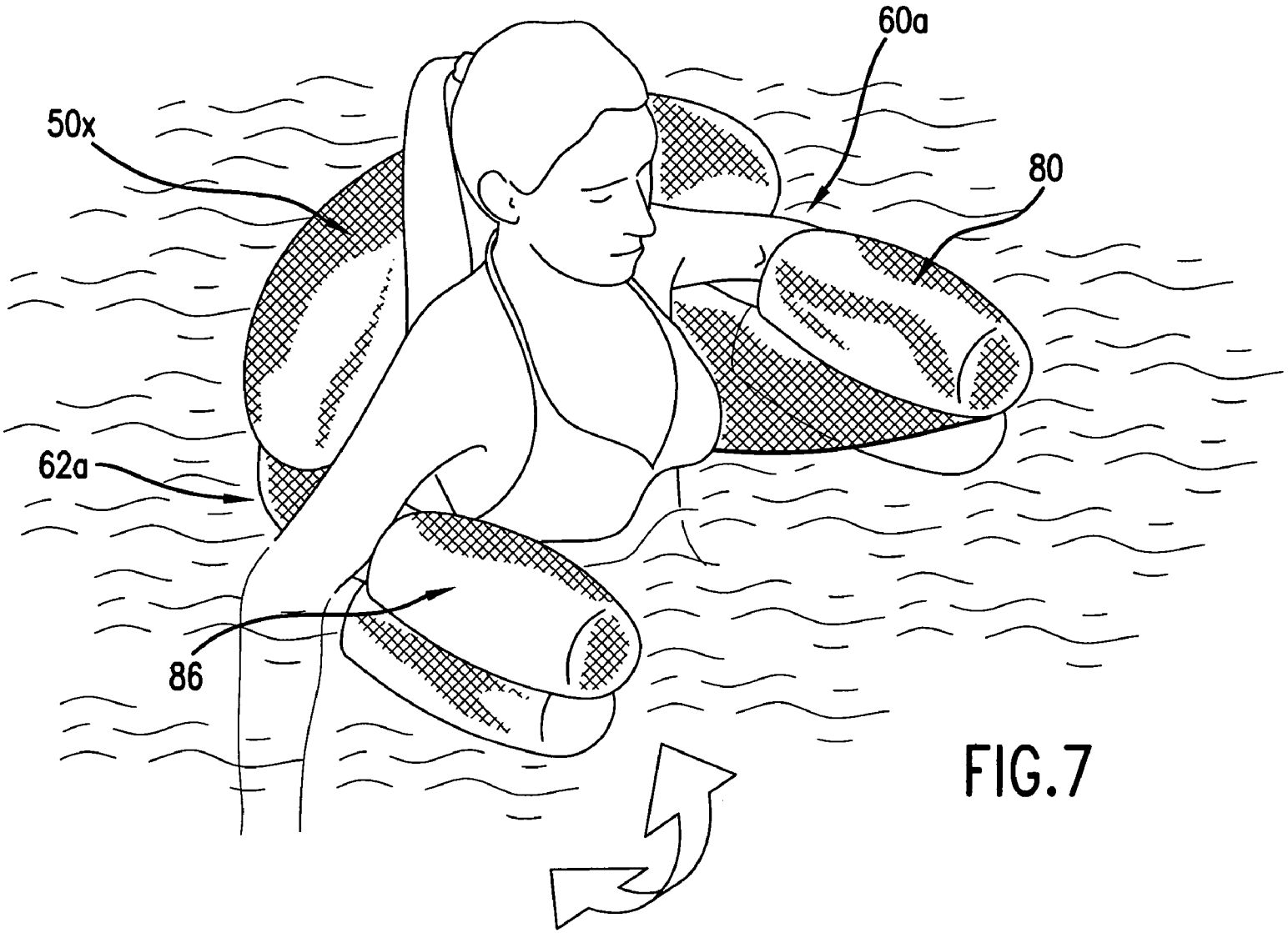
FIG. 7 illustrates the assembly of FIG. 6 in use by a user.

The assembly 20*a* can be positioned in several different configurations for use, thereby enhancing its utility to the user. For example, the user can use the assembly 20*a* in the same manner described above for the assembly 20, as shown in FIG. 5. Alternatively, the assembly 20*a* can be folded in half about the dividing line D as shown in FIG. 6, so that the floatation devices 82, 88 and 50*a* are positioned under the floatation devices 80, 86 and 50*x*, respectively. The folded assembly 20*a* can then be floated on the water, and the user can rest his/her upper body on the folded assembly 20*a*, with the user's lower body submerged in the water, as shown in FIG. 7. The user's arms can still extend through the spaces 60*a*, 62*a*, with the head rested against the floatation device 50*x*. However, the user's lower body can now be submerged in the water, which can be desirable on warmer days. In addition, the folded assembly 20*a* can also function as a backrest for a user in a swimming pool, where the folded assembly 20*a* can be urged against a wall of a swimming pool, and the user standing in the pool and resting the user's back against the assembly 20*a* as shown in FIG. 7.

To store the assembly 20*a*, the user first deflates the floatation devices 50 so that the entire assembly 20*a* can have a generally flat profile. The sheet material 30*a* of the assembly 20*a* can then be folded a compact configuration for storage.

Figure 8:
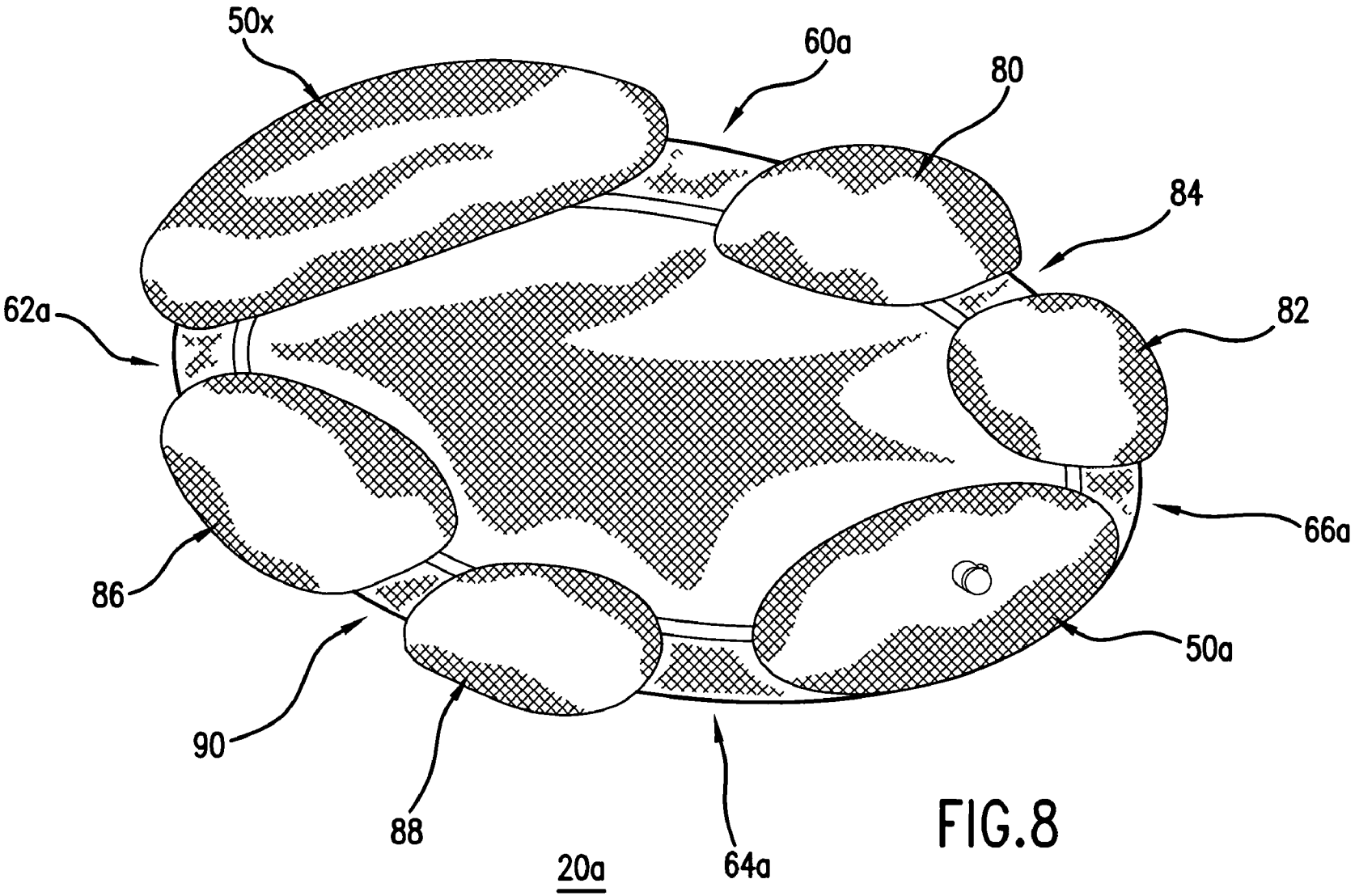
FIG. 8 is a perspective view of the floating assembly of FIG. 4 configured in a different shape.

FIG. 8 illustrates the assembly 20*a* of FIG. 4 configured in a different shape, such as oval. Otherwise, the assembly 20*a* in FIGS. 4 and 8 can be the same.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A floating apparatus for suspending a person on water, comprising:

a sheet material defining a periphery for the floating apparatus; and a plurality of floatation devices attached to the periphery, including a top floatation device that forms a head pillow, a first side floatation device, a second side floatation device positioned opposite to the first side floatation device, a third side floatation device positioned adjacent the first side floatation device and separated therefrom by a first gap, and a fourth side floatation device positioned adjacent the second side floatation device and separated therefrom by a second gap;

a first arm space defined between the top floatation device and the first side floatation device, and a second arm space defined between the top floatation device and the second side floatation device;

a fold line defined by the first gap and the second gap; and wherein the sheet material is folded about the fold line, with the third side floatation device positioned below the first side floatation device, and the fourth side floatation device positioned below the second side floatation device.

2. The assembly of claim 1, further including:

a bottom floatation device positioned opposite the top floatation device, with a first leg space defined between the bottom floatation device and the third side floatation device, and a second leg space defined between the bottom floatation device and the fourth side floatation device.

* * * * *